US005452532A

United States Patent [19]

Nishio

[11] Patent Number: 5,452,532

[45] Date of Patent: Sep. 26, 1995

[54] CUSTOMIZABLE SIGN HAVING TRANSLUCENT BORDER AROUND RETROREFLECTIVE MESSAGE

[76] Inventor: Dan Nishio, 190 Flying Cloud Isle, Foster City, Calif. 94404

[21] Appl. No.: 126,524

[22] Filed: Sep. 24, 1993

Related U.S. Application Data

[63] Continuation-in-part of Ser. No. 964,369, Oct. 21, 1992, Pat. No. 5,303,492.

[51] Int. Cl.[6] ..... G09F 13/16

[52] U.S. Cl. ..... 40/583; 40/612; 359/529

[58] Field of Search ..... 40/582, 583, 612, 40/615; 359/528, 529, 530

[56] References Cited

U.S. PATENT DOCUMENTS

| | | | |
|---|---|---|---|
| 919,310 | 4/1909 | Boehm | 40/583 |
| 1,348,816 | 8/1920 | Limpert | 40/583 |
| 1,878,909 | 9/1932 | Stimsom | 359/528 |
| 1,893,024 | 1/1933 | Gill . | |
| 1,906,504 | 5/1933 | Allison, Jr. | 40/583 |
| 1,950,560 | 3/1934 | Martinek et al. | 359/528 X |
| 2,012,933 | 8/1935 | Davidson | 359/528 X |
| 2,153,850 | 4/1939 | Stedman | 40/583 |
| 2,310,665 | 2/1943 | Williams | 40/583 |
| 2,317,162 | 4/1943 | Wood | 40/583 X |
| 2,365,447 | 12/1944 | Best | 40/583 X |
| 2,910,792 | 11/1959 | Pfaff | 40/130 |
| 3,335,671 | 12/1967 | Nier | 40/615 |
| 3,399,477 | 9/1968 | Johnson, Jr. et al. | 40/583 |
| 4,846,549 | 7/1989 | Gutsche | 350/101 |
| 5,050,327 | 9/1991 | Woltman | 40/582 |
| 5,122,902 | 6/1992 | Benson | 359/529 |

FOREIGN PATENT DOCUMENTS

| | | | |
|---|---|---|---|
| 395176 | 10/1990 | European Pat. Off. | 40/583 |

*Primary Examiner*—Brian K. Green

[57] ABSTRACT

A road sign for clearly presenting a customizable message to a driver under direct and back lighting conditions, comprising a background board with an array of mounting holes. Message elements and background elements are placed into the appropriate holes to form a mosaic message. Each mosaic message has a retroreflective portion surrounded by a translucent border. When the sign is illuminated by direct lighting, such as a driver's own headlights, the retroreflective portion will reflect much of the light so that the message will be clearly visible to the driver. When the sign is illuminated by strong back lighting, such as a low sun or oncoming headlights, the translucent border will glow brightly so that the message will be clearly seen by the driver as an outline of the message. The message elements can be rearranged to form a variety of different possible messages and graphical designs.

3 Claims, 2 Drawing Sheets

CUSTOMIZABLE SIGN HAVING TRANSLUCENT BORDER AROUND RETROREFLECTIVE MESSAGE

This is a continuation-in-part of Ser. No. 07/964,369, filed Oct. 21, 1992 now U.S. Pat. No. 5,303,492.

FIELD OF THE INVENTION

This invention relates generally to signs, specifically to a customizable commercial, informational, or traffic sign.

BACKGROUND OF THE INVENTION

Conventional traffic or road signs currently in widespread use are made of a strong metal sheet or backplane supported on a post. The backplane is painted with a background color, while the words and symbols, or informational legend, are painted over the background in contrasting colors. A typical example is a "STOP" sign, which has an octagonal backplane with a red background, a white border around the backplane, and the word "STOP" in white letters. The chosen colors of these road signs are intended to be conspicuous so that the signs are easily noticed by drivers, while the color combinations are highly contrasting so that the information can be easily discernible from a distance. In addition, the paints used on the signs are substantially reflective such that at night, when they are directly illuminated by approaching headlights, they reflect much of the light back to the drivers. Therefore, the signs should theoretically be highly legible in the dark.

In practice, the readability of conventional signs depend upon the actual viewing conditions. The signs are adequately legible when their front faces are illuminated by frontal or direct lighting during the day, and direct lighting by headlights during the night. However, if they are predominately illuminated from the back, or backlit, by the sun, a bright haze, or oncoming headlights, the areas surrounding the signs can appear very bright, while the faces of the signs can appear so dark that they can become unreadable.

Some signs have been designed to alleviate this back lighting problem. U.S. Pat. No. 5,050,327 to Woltman (1991) shows a sign with legend segments or letters which are mostly retroreflective, but somewhat translucent. Under direct lighting, the legend will reflect much of the light such that it will be highly visible. On the other hand, when the sign is backlit by the sun or oncoming headlights, the slightly translucent legend will allow some of the light to pass through so as to make the legend glow against the dark background of the sign. The glowing message will allow the sign to be more readily readable when backlit. However, utilizing the retroreflectivity and translucency of the same material has a tradeoff: The more retroreflective the material, the less translucent it is, and vice versa. Therefore, the readability of the sign will be highly compromised, such that it will either be very readable in direct lighting, but not in back lighting, or it will be very readable in back lighting, but not in direct lighting.

U.S. Pat. No. 4,846,549 to Gutsche (1989) shows a display device, in FIG. 3, which has entirely translucent legend segments. When strongly backlit, lenses behind the translucent segments focus light onto the segments as bright spots, such that the segments appear as lines of bright dots. However, this sign will only work in this manner if the back lighting occurs at almost normal to the plane of the sign, otherwise the focal points of the lenses will not fall onto the translucent segments. Moreover, the purely translucent segments will reflect little light, such that they will be very difficult to read in direct or oblique lighting.

In conclusion, no existing sign is highly readable in direct, oblique, and back lighting conditions. Furthermore, none is customizable for creating a variety of different messages.

SUMMARY OF THE INVENTION

Accordingly, several objects and advantages of the invention are to provide a sign which is clearly readable and discernible in direct, oblique, and back lighting conditions, which may be clearly seen from various angles, and which can be highly customizable for forming a variety of different messages.

Further objects and advantages will become apparent from a study of the following description and the accompanying drawings.

In a preferred embodiment of the invention, the sign is comprised of an opaque background board with an array of mounting holes on its face. A number of retroreflective message elements with translucent borders, in conjunction with a number of opaque background elements, are each placed into the appropriate mounting hole to form custom messages.

When the sign is lit by direct lighting, the retroreflective portion of the message will reflect much of the light, so that the information will be clearly seen by drivers. When the sign is strongly backlit by the sun or oncoming headlights, the translucent border of the message will glow brightly, so that a bright outline of the message will be clearly seen by drivers.

DESCRIPTION—FIG. 1

Figure 1:
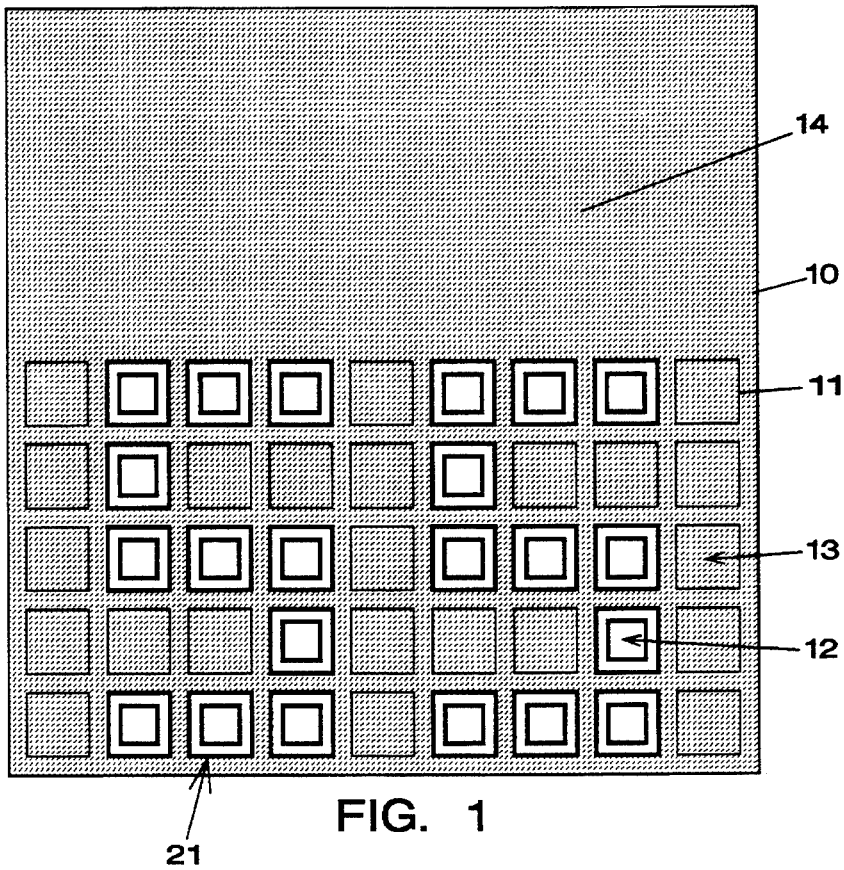
FIG. 1 is front view of a sign in accordance with a first embodiment of the invention.

In accordance with a first embodiment of the invention shown in FIG. 1, a customizable sign is comprised of a background board 10 with an array of square mounting holes 11. A number of retroreflective and translucent message elements 12 are placed into the appropriate mounting holes to form a mosaic message 21. The example shown is the number "55", but a wide range of other messages can be easily formed in this manner. Background board 10 and message elements 12 are in highly contrasting colors to maximize legibility. For example, background board 10 can be in a dark color, such as matte black, and message elements 12 can be in bright primary colors. Opaque background elements 13, which are of the same color as background board 10, fill in the rest of the mounting holes 11 to create a uniform backdrop for the message. An optional information area 14 above message 21 allows the placement of additional information such as printed graphics.

DESCRIPTION—FIG. 2

Message element 12 is shown here in a side sectional view. Message element 12 is hollow, and has flat horizontal sides 15 and a front facing pyramid 16. Message element 12 is secured within a mounting hole 11 of sign board 10 by an integral flange 17 around the perimeter of pyramid 16, and a rear panel 18, which is secured to sides 15 by screws 19, although other fasteners can be used. Flange 17 and rear panel 18 are slightly larger than hole 11, so that they engage the front and rear surfaces, respectively, of background board 10 to secure message element 12 in place. A retroreflective sheet 20 is attached to the inside surface of pyramid 16. Retroreflective sheet 20 is partially translucent, so that a portion of the light striking it will pass through.

Pyramid 16 and sides 15 are made as a single piece of a highly transparent and colorless material such as acrylic, and rear panel 18 is made of a translucent material such as colorless frosted, or translucent colored acrylic. Retroreflective sheet 20 is made of a material such as silver LLUMAR (available at Tap Plastics, San Francisco), which is mostly retroreflective but partially translucent. Message element 12 can be made in various bright colors for enhancing the attractiveness and legibility of message 21.

DESCRIPTION—FIG. 3

Message element 12 is shown here in a front view. When the element is illuminated by frontal lighting, such as oncoming headlights, retroreflective sheet 20 under pyramid 16 will reflect much of the light back to the source, so that the message will be clearly seen by drivers approaching the sign.

Figure 2:
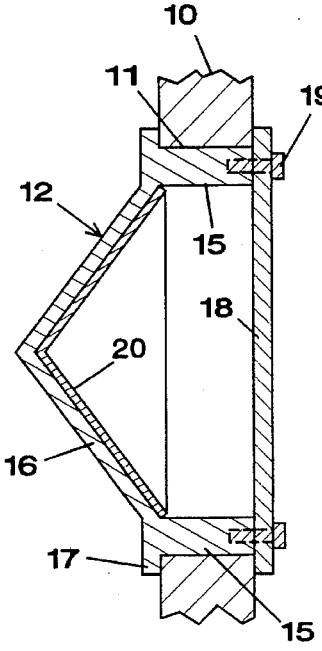
FIG. 2 is an side sectional view of the message element of FIG. 1.

When light is predominately directed at the rear of message element 12, such as when the sign is backlit during the early morning or late afternoon, some of the light will be transmitted through rear panel 18 (FIG. 2) and retroreflective sheet 20, so that pyramid 16 will glow moderately. In addition, the four transparent sides 15 will transmit all of the diffused light passing through translucent rear panel 18, so that sides 15 will glow as a very bright border around pyramid 16. As a result, the message will be clearly visible, even under adverse lighting conditions. Pyramid 16 will reflect light from a wide range of angles, so that message element 12 will be clearly visible even if the viewer is substantially offset to one side of the sign.

DESCRIPTION—FIG. 4

Opaque background element 13 is shown here in a side sectional view. Background element 13 has sides 22, a flat face 23, a flange 24, and a rear panel 25. All components of background element 13 are entirely made of opaque materials, such as colored or painted ABS plastic, and has no retroreflective sheet installed. Alternatively, the individual rear panels 25 of message elements 12 (FIG. 1 ) can be replace with a single large panel that can hold all message elements 12 on background board 10.

DESCRIPTION—FIG. 5

Figure 3:
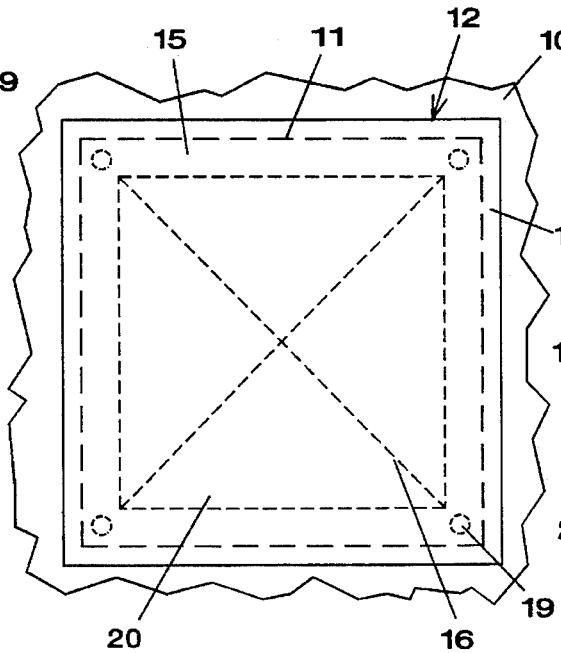
FIG. 3 is a front view of the message element of FIG. 1.
Figure 4:
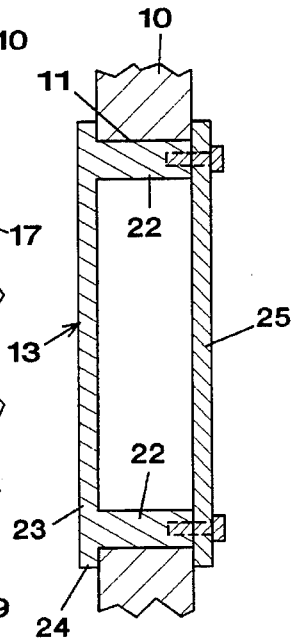
FIG. 4 is a side sectional view of the background element of FIG. 1.
Figure 5:
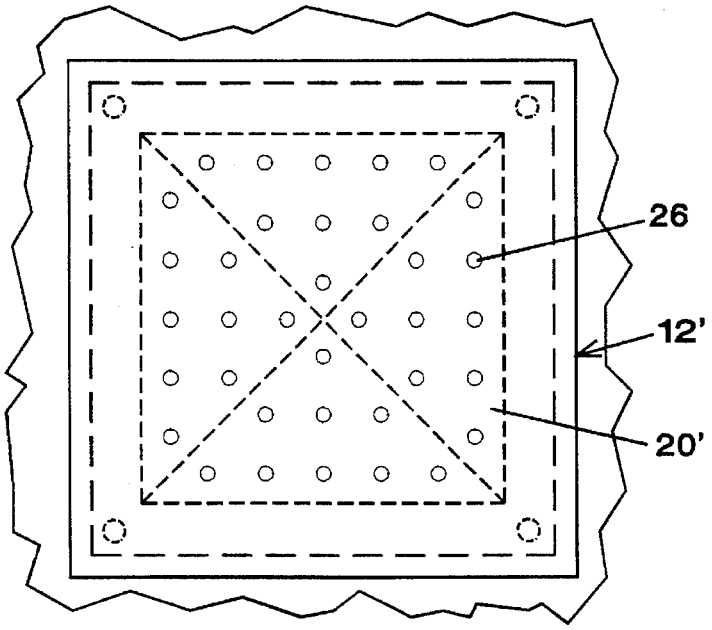
FIG. 5 is a front view of a second embodiment of the invention.

In accordance with a second embodiment of the invention, a message element 12' is mostly identical to that shown in FIG. 3, the only difference being the addition of optical apertures 26 in retroreflective sheet 20'. Each aperture 26 can be a simple hole, or a hole filled with a translucent material such as acrylic. Apertures 26 will glow brightly when backlit to further enhance the visibility of the message during adverse lighting conditions, but they are small enough so that the retroreflective quality of retroreflective sheet 20' is only marginally reduced.

DESCRIPTION—FIG. 6

In accordance with a third embodiment of the invention, a mosaic message 21' is comprised of message elements 27 with a retroreflective center portion 28 partially surrounded by a translucent border 29. Unlike the pyramidal message elements 12 shown in FIGS. 2 and 3, message elements 27 have flat faces. In this example, message 21' is the number "55" with chamfered corners. Also in this example, message elements 27 are in four graphical forms, including an end segment 30, a middle segment 31, a chamfered segment 32, and a corner segment 33. These graphical forms are suitably arranged to form message 21'. Each translucent border 29 only partially surrounds each retroreflective center portion 28, so that one or more substantial segments of each retroreflective portion's periphery is devoid of the translucent border. The result of this arrangement is a highly visible and legible message.

Figure 6:
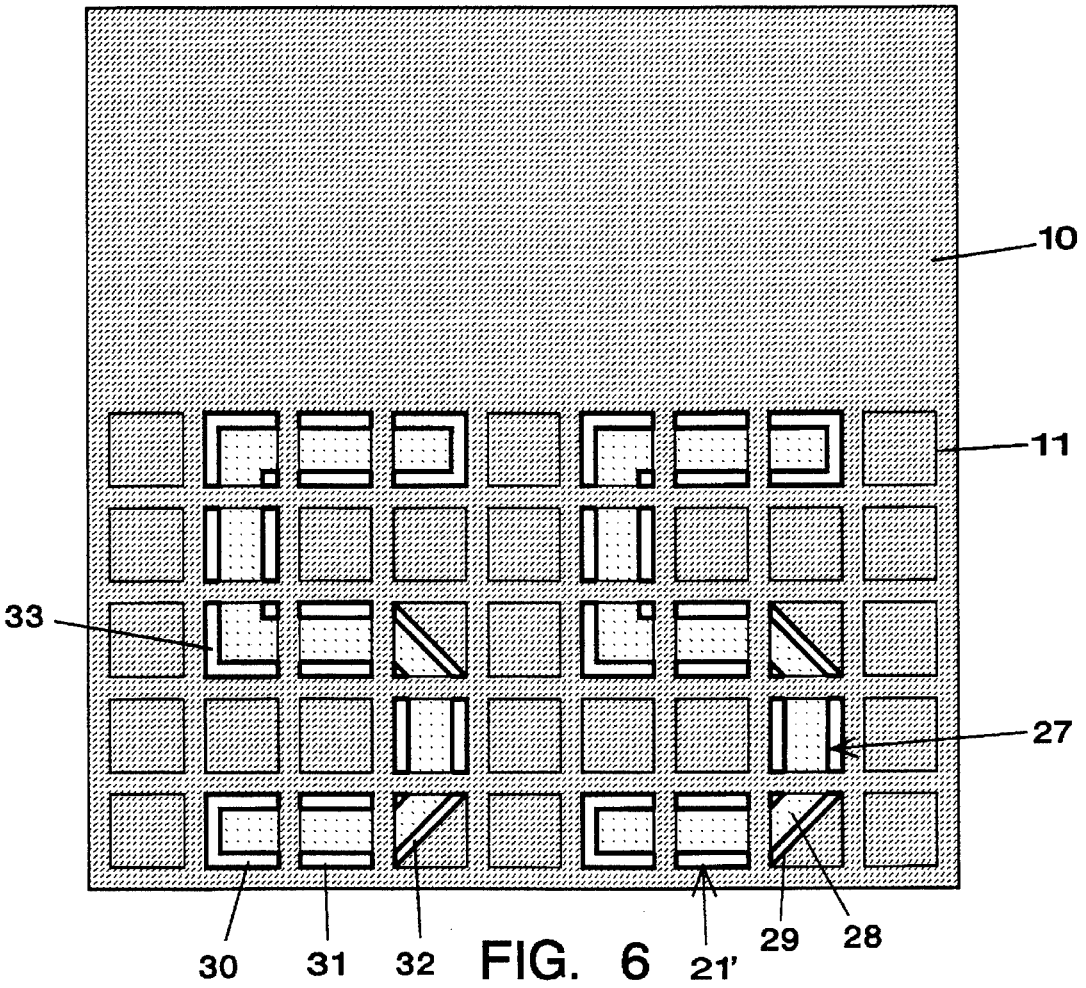
FIG. 6 is a front view of a third embodiment of the invention.

Although the above descriptions are specific, they should not be considered as limitations on the scope of the invention, but only as examples of the embodiments. Many other ramifications and variations are possible within the teachings of the invention. For example, glass can be used in place of acrylic. Retroreflective sheet 20 can be made of other materials. Other types of fasteners can be used in place of screws 19. The screws can be threaded into the front side of background board 10 through flange 17, so that rear panel 18 can be omitted. Instead of being square, message elements 12 and 27 can be of other shapes, such as rectangular, round, etc. Translucent border 29 in the embodiment shown in FIG. 6 can be made in forms and shapes other than the examples shown. Different message element and translucent border combinations, and colors can be used to produce a variety of graphics and letters. Therefore the reader is requested to determine the scope of the invention by the appended claims and their legal equivalents, and not by the examples given.

I claim:

1. A customizable sign, comprising:

a background board having front and back sides, a plurality of mounting holes arranged on said background board, a plurality of translucent message elements removably mountable in selected mounting holes for changeably forming a mosaic message, and a partially translucent reflective planar sheet attached to each of said message elements, whereby when light is directed at said message elements, said light is substantially reflected by the partially translucent reflective sheets.

2. A customizable sign, comprising:

a background board having front and back sides, a plurality of mounting holes arranged on said background board, a plurality of translucent message elements removably mountable in selected mounting holes for changeably forming a mosaic message, each of said message elements includes a plurality of optical apertures, and a reflective sheet attached to each of said message elements, whereby when light is directed at said message elements, said light is substantially reflected by the reflective sheets.

3. A customizable sign, comprising:

a background board, a plurality of mounting holes arranged on said background board, and a plurality of message elements removably mountable in selected mounting holes for changeably forming a mosaic message, each of said message elements having a reflective portion with a plurality of optical apertures arranged thereon, the reflective portions being provided in a plurality of different graphical forms each partially surrounded by a translucent border, said message elements are arrangeable on said background board for changeably forming a mosaic message, said message elements are arrangeable so that the translucent borders around said graphical forms cooperate to form a generally continuous translucent outline around said mosaic message.

* * * * *